US006579826B2

(12) United States Patent
Furuya et al.

(10) Patent No.: US 6,579,826 B2
(45) Date of Patent: Jun. 17, 2003

(54) REVERSIBLE THERMOSENSITIVE RECORDING MEDIUM AND IMAGE FORMING AND ERASING METHOD USING THE RECORDING MEDIUM

(75) Inventors: Hiromi Furuya, Shizuoka-ken (JP); Tadafumi Tatewaki, Shizuoka-ken (JP); Satoshi Arai, Shizuoka-ken (JP); Takeshi Shibuya, Shizuoka-ken (JP); Kyoji Tsutsui, Shizuoka-ken (JP)

(73) Assignee: Ricoh Company Limited, Tokyo (JP)

( * ) Notice: Subject to any disclaimer, the term of this patent is extended or adjusted under 35 U.S.C. 154(b) by 86 days.

(21) Appl. No.: 09/972,860

(22) Filed: Oct. 10, 2001

(65) Prior Publication Data

US 2002/0072472 A1 Jun. 13, 2002

(30) Foreign Application Priority Data

Oct. 10, 2000 (JP) ..... 2000-308922
Nov. 28, 2000 (JP) ..... 2000-360426

(51) Int. Cl.[7] ..... B41M 5/30
(52) U.S. Cl. ..... 503/201; 503/209
(58) Field of Search ..... 503/201, 209

(56) References Cited

U.S. PATENT DOCUMENTS

| | | | | |
|---|---|---|---|---|
| 5,489,494 | A | 2/1996 | Hotta et al. | 430/19 |
| 5,538,822 | A | 7/1996 | Hotta et al. | 430/19 |
| 5,547,500 | A | 8/1996 | Tsutsui | 106/21 A |
| 5,616,262 | A | 4/1997 | Itoda et al. | 219/216 |
| 5,622,909 | A | 4/1997 | Furuya et al. | 503/216 |
| 5,635,319 | A | 6/1997 | Hotta et al. | 430/19 |
| 5,641,724 | A | 6/1997 | Yamaguchi et al. | 503/221 |
| 5,686,382 | A | 11/1997 | Suzuki et al. | 503/201 |
| 5,703,005 | A | 12/1997 | Torii et al. | 503/201 |
| 5,716,477 | A | 2/1998 | Yamaguchi et al. | 156/230 |
| 5,747,413 | A | 5/1998 | Amano et al. | 503/201 |
| 5,866,505 | A | 2/1999 | Furuya et al. | 503/201 |
| 5,868,821 | A | 2/1999 | Torii et al. | 106/31.17 |
| 5,869,422 | A | 2/1999 | Kazumi et al. | 503/207 |
| 5,880,445 | A | 3/1999 | Mori et al. | 235/380 |
| 5,891,823 | A | 4/1999 | Torii et al. | 503/216 |
| 5,932,516 | A | 8/1999 | Torii et al. | 503/216 |

(List continued on next page.)

FOREIGN PATENT DOCUMENTS

| | | |
|---|---|---|
| JP | 60-193691 | 10/1985 |
| JP | 62-048585 | 3/1987 |
| JP | 02-188293 | 7/1990 |
| JP | 05-124360 | 5/1993 |
| JP | 05-286258 | 11/1993 |
| JP | 06-210954 | 8/1994 |
| JP | 07-068937 | 3/1995 |
| JP | 07-113055 | 5/1995 |
| JP | 08-224960 | 9/1996 |
| JP | 09-207437 | 8/1997 |
| JP | 10-100536 | 4/1998 |
| JP | 10-100541 | 4/1998 |

*Primary Examiner*—B. Hamilton Hess
(74) *Attorney, Agent, or Firm*—Oblon, Spivak, McClelland, Maier & Neustadt, P.C.

(57) ABSTRACT

A reversible thermosensitive recording medium including a substrate; a reversible thermosensitive recording layer on the substrate, which includes an electron donating coloring compound and an electron accepting compound, wherein the recording layer achieves a colored state when heated at a temperature not lower than an image forming temperature and then cooled at a first cooling speed, and the recording layer in the colored state achieves a non-colored state when heated at a temperature lower than the image forming temperature and not lower than an image erasing temperature or when heated at a temperature not lower than the image forming temperature and then cooled at a second cooling speed relatively slow compared to the first cooling speed; and a crosslinked polymer layer including a crosslinked polymer having an ultraviolet absorbing structure.

26 Claims, 3 Drawing Sheets

U.S. PATENT DOCUMENTS 5,942,377 A 8/1999 Torii et al. ..... 430/338
5,948,727 A 9/1999 Hotta et al. ..... 503/200
5,955,225 A 9/1999 Furuya et al. ..... 430/19
5,981,115 A 11/1999 Furuya et al. ..... 430/19
5,981,429 A 11/1999 Kawamura et al. ..... 503/207
6,001,159 A 12/1999 Furuya et al. ..... 106/31.17
6,063,173 A 5/2000 Torii et al. ..... 106/31.17
6,090,192 A 7/2000 Torii et al. ..... 106/31.18
6,090,748 A 7/2000 Furuya et al. ..... 503/201
6,117,562 A 9/2000 Yamaguchi et al. ..... 428/537
6,154,243 A 11/2000 Tatewaki et al. ..... 347/223
6,172,001 B1 1/2001 Hotta et al. ..... 503/201
6,261,992 B1 7/2001 Furuya et al. ..... 503/201

REVERSIBLE THERMOSENSITIVE RECORDING MEDIUM AND IMAGE FORMING AND ERASING METHOD USING THE RECORDING MEDIUM

BACKGROUND OF THE INVENTION

1. Field of the Invention

The present invention relates to a reversible thermosensitive recording medium, and more particularly to a reversible thermosensitive recording medium utilizing a coloring reaction of an electron donating coloring compound with an electron accepting compound. In addition, the present invention relates to an image forming and erasing method using the reversible thermosensitive recording medium.

2. Discussion of the Background

In view of environmental problems such as increase of dust and destruction of forests, considerable attention is currently placed on reversible thermosensitive recording media which can reversibly record and erase an image many times. Therefore various reversible thermosensitive recording media have been proposed, and some of the recording media are marketed now.

For example, Japanese Laid-Open Patent Publications Nos. (hereinafter referred to as JOP) 63-107584 and 4-78573 have disclosed polymer-type reversible thermosensitive recording media utilizing a physical change, in which a transparent state and an opaque state are reversibly achieved upon application of heat thereto.

In addition, JOPs 60-193691 and 2-188293 have disclosed dye-type reversible thermosensitive recording media utilizing a chemical change, in which a combination of gallic acid with phloroglucinol is used, or a salt of a higher aliphatic amine and bis(hydroxyphenyl)acetic acid or gallic acid is used as a color developer.

Some of the present inventors and other inventors propose a reversible thermosensitive recording medium using a coloring agent and a color developer in JOP 5-124360, etc. Namely, by using a combination of a specific color developer (i.e., an electron accepting compound) with a specific coloring agent (i.e., a leuco dye, or an electron donating coloring compound), a color image can be easily formed and erased reversibly when properly controlling heating and cooling conditions. The reversible thermosensitive recording medium can reversibly achieve a colored state and a non-colored state many times, and the colored state and non-colored state can be stably maintained at room temperature.

Such a reversible thermosensitive recording medium has been improved as disclosed in JOP 6-210954, and is now used for, for example, point cards in which information of the amounts of points given to a user proportionally to the total purchase amounts in a shop is displayed.

Reversible thermosensitive recording media including a combination of a color developer and a leuco dye have a drawback in that when the recording media are exposed to light for a long period of time, the media tend to color blown and the color cannot be erased. The reason is considered to be that the molecular structure of the leuco dye changes due to irradiation of light, resulting in formation of irreversible colored materials.

Conventional irreversible thermosensitive recording media including a combination of a leuco dye and a color developer also have such a coloring problem. In attempting to solve the problem, an ultraviolet absorbent is typically included in the irreversible thermosensitive recording media to prevent the leuco dye being exposed to ultraviolet light.

For example, JOP 62-48585 discloses an irreversible thermosensitive recording medium in which an intermediate layer including a low molecular weight ultraviolet absorbent is formed between a recording layer and a protective layer.

The present inventors find that when this technique is applied to a reversible thermosensitive recording medium, a problem which occurs is that the coloring/erasing properties of the recording medium are changed because the main component of the ultraviolet absorbent migrates to the recording layer. In addition, it is also found that big problems tend to occur such that the ultraviolet absorbent migrates to the surface of the protective layer, resulting in deterioration of ultraviolet light absorbability of the recording medium, and image qualities deteriorate because the migrated ultraviolet absorbent adheres to a thermal printhead serving as an image writing device.

JOP 7-68937 discloses a reversible thermosensitive recording medium including a protective layer which includes a microencapsulated ultraviolet absorbent which is liquid at room temperature. This microencapsulated ultraviolet absorbent is used to prevent the ultraviolet absorbent from bleeding out. However, the protective layer has a drawback of having poor film strength because of including a liquid phase, and thereby the protective layer deforms after long repeated use. In addition, if the microcapsule is damaged, various problems occur such that the coloring/erasing properties deteriorate; a thermal printhead is contaminated, resulting in deterioration of image qualities; and users are contaminated. Therefore, this method can fully solve the coloring problem.

JOP 10-100541 discloses a reversible thermosensitive recording medium in which a particulate inorganic pigment having ultraviolet-ray masking ability is included in an intermediate layer or a protective layer. Since the particulate inorganic pigment has a controlled particle size, the resultant layer has ultraviolet scattering ability. Therefore the layer has a combination of ultraviolet absorbing ability and ultraviolet scattering ability, and thereby the recording layer is prevented from being exposed to ultraviolet rays.

However, in this method a large amount of a very fine inorganic pigment has to be included in the intermediate or protective layer. Therefore, the layer is brittle. When a reversible thermosensitive recording medium including such a brittle layer is processed so as to be a sheet or a card, a problem such that the edges of the sheet or card have burrs. In addition, such reversible thermosensitive recording medium has high manufacturing costs because the fine inorganic pigment is very expensive. Further, the properties of such a recording medium largely change depending on the dispersion of the very fine inorganic pigment, and therefore problems with image qualities often occur.

In addition, JOPs 8-224960 and 9-207437 have disclosed reversible thermosensitive recording media which include a protective layer including a polymer having ultraviolet absorbability.

In general, the protective layer of a reversible thermosensitive recording medium has to have high heat resistance and durability, and therefore a resin layer crosslinked upon application of heat or ultraviolet rays is typically used as the protective layer. When a polymer which has ultraviolet absorbability and which is not crosslinked is used for the protective layer, the resultant recording medium has poor heat resistance and durability.

Even when a combination of a polymer having ultraviolet absorbability with a crosslinkable resin is used to form a protective layer in which the polymer is fixed by the crosslinked resin, the film strength of the protective layer deteriorates similarly to the protective layer including a microcapsule mentioned above, and thereby the non-crosslinked polymer having ultraviolet absorbability is firstly damaged and then the surface of the recording medium deforms after long repeated use. Therefore, bad image formation/erasure problems occur, resulting in shortage of the life of the recording medium.

As can be understood from the above-description, a reversible thermosensitive recording medium having a good combination of light resistance and durability has not yet been developed.

In JOPs 13-180188 and 13-180116, the present inventors have proposed a reversible thermosensitive recording medium which includes a combination of an electron donating coloring compound and an electron accepting compound and which is used for forming a temporary document such as documents for a meeting.

Such a document-use reversible thermosensitive recording medium has a function in which plural images stored in a computer as digital information are illustrated in plural sheets of the recording medium, which a user can see while comparing the plural images. Therefore the document-use reversible thermosensitive recording medium is required to be easy to handle. Namely, the medium is required to be freely arranged on a table; to be rearranged; to be seen while a user picks up it; and be able to rewrite an image, if desired.

Thus, the document-use reversible thermosensitive recording medium is used under various conditions, and often has a chance of being exposed to light, which is different from the card-use reversible thermosensitive recording medium.

There is no proposal for a document-use reversible thermosensitive recording medium having an excellent combination of light resistance and durability. Namely it is a new issue to be addressed.

In addition, if the document-use reversible thermosensitive recording medium preferably has a good writing ability such that an image can be easily written by a general writing material such as markers on the surface of the recording medium and the written image is also easily erased, the recording medium will be able to be widely used. However, reversible thermosensitive recording media has a drawback in that when images are written on the surface thereof using a general writing material, the recording media cannot be used thereafter because the images are hardly erased.

JOP 7-113055 discloses a heat-erasable ink by which a heat-erasable image can be written on the surface of reversible thermosensitive recording media. However, since the constituents of the ink image written by a writing material on reversible thermosensitive recording media remain on the surface of the recording media even after the image is non-colored upon application of heat. Therefore, when the recording media are repeatedly used while being heated by a thermal printhead, the recording media tend to produce an undesired image because the remaining constituents adhere to the thermal printhead.

JOPs 10-100536 and 5-286258 have disclosed display media in which a reversible thermosensitive recording layer is formed on one side of a transparent support and an image can be written by a writing material on the other side of the support. However, the recording media have drawbacks in that the support is limited to transparent materials and the media have poor visibility (i.e., poor visual property) because a user looks a recorded image through the support.

Because of these reasons, a need newly exists for a document-use reversible thermosensitive recording medium having a surface having good writing/erasing properties and capable of reversibly forming and erasing an image many times while having good light resistance.

SUMMARY OF THE INVENTION

Accordingly, an object of the present invention is to provide a reversible thermosensitive recording medium which can reversibly form and erase an good image without causing deformation even after long repeated use while having a good light resistance and which can be used for document applications as well as card applications.

Another object of the present invention is to provide a reversible thermosensitive recording medium having a surface on which an image can be written by a writing material and the image can be erased by an eraser such as non-woven cloths, papers, sponges, rubbers, cloths, etc. without a residue thereon while the image has a fixability so as not to be easily erased when contacted with other documents.

Briefly these objects and other objects of the present invention as hereinafter will become more readily apparent can be attained by a reversible thermosensitive recording medium having a substrate; a recording layer on the substrate, which includes an electron donating coloring compound and an electron accepting compound, wherein the recording layer achieves a colored state when heated at a temperature not lower than an image forming temperature and then cooled at a cooling speed, and the recording layer in the colored state achieves a non-colored state when heated at a temperature lower than the image forming temperature and not lower than an image erasing temperature or when heated at a temperature not lower than the image forming temperature and then cooled at a cooling speed relatively slow compared to the first-mentioned cooling speed; and a crosslinked polymer layer having an ultraviolet absorbing structure.

The recording layer may serve as the crosslinked polymer layer, however, the crosslinked polymer layer is preferably formed on the recording layer. In addition, the crosslinked polymer layer preferably has a viscoelastic logarithmic decrement property such that a peak temperature is not lower than 100° C., and a logarithmic decrement at the peak temperature is not greater than 0.3. Alternatively, the crosslinked polymer layer may have a peak temperature not lower than 150° C., and a logarithmic decrement at the peak temperature is not greater than 0.6.

The ultraviolet absorbing structure is at least one of a benzotriazol structure and a benzophenone structure.

In addition, it is preferable that the polymer has a hydroxyl group and is crosslinked using an isocyanate compound as a hardener.

Further, the surface of the reversible thermosensitive recording medium has a dynamic receding contact angle against water of from 75° to 100°. The crosslinked polymer layer is preferably the surface layer, and a silicone-modified polymer is preferably included in the crosslinked polymer layer, which is preferably crosslinked with the polymer having an ultraviolet absorbing structure. The surface layer preferably includes a filler. It is preferable that the filler is coated with a calcium compound and has an average particle diameter of from 0.2 to 2.0 $\mu$m.

The substrate is preferably a paper.

The recording medium may be a card, a sheet or a roll, and may have a print layer and/or an information storing portion such as magnetic recording layers.

In another aspect of the present invention, a reversible thermal image recording method is provided which includes the steps of:

providing the reversible thermosensitive recording material of the present invention; and imagewise heating the recording material at a temperature not lower than an image forming temperature and then cooled rapidly to form an image in the recording layer.

In yet another aspect of the present invention, a reversible thermal image erasing method is provided which includes the steps of:

providing the reversible thermosensitive recording material of the present invention; and heating the recording material at a temperature lower than an image forming temperature such that the recording layer achieves a non-colored state.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

As a result of the present inventors' investigation to attain the above-mentioned first object of the present invention, it is found that to use a crosslinked polymer having an ultraviolet absorbing structure is very effective for imparting a good combination of light resistance and durability to the resultant recording medium.

Namely, according to the present invention, a reversible thermosensitive recording medium is provided which has a substrate; a recording layer which is formed on the substrate and which includes an electron donating coloring compound and an electron accepting compound, wherein the recording layer achieves a colored state when heated at a temperature not lower than an image forming temperature and then cooled at a cooling speed, and the recording layer in the colored state achieves a non-colored state when heated at a temperature lower than the image forming temperature and not lower than an image erasing temperature or when heated at a temperature not lower than the image forming temperature and then cooled at a cooling speed relatively slow compared to the first-mentioned cooling speed; and a crosslinked polymer layer having an ultraviolet absorbing structure.

In addition, the present inventors discover that the durability of the crosslinked polymer layer depends on viscoelastic properties of the crosslinked polymer. Therefore, the present inventors have investigated the viscoelastic properties of crosslinked polymer layers in detail. As a result thereof, it is found that the durability of the crosslinked polymer layer depends on the viscoelastic logarithmic decrement property which is measured by a rigid pendulum automatic damped vibration method using a rigid-type physical properties testing instrument. Specifically, it is found that when the crosslinked polymer layer has a viscoelastic logarithmic decrement property such that a peak temperature is not lower than 100° C. and a logarithmic decrement at the peak temperature is not greater than 0.3, or a peak temperature is not lower than 150° C. and a logarithmic decrement at the peak temperature is not greater than 0.6, a good durability can be imparted to the crosslinked polymer layer.

Figure 2:
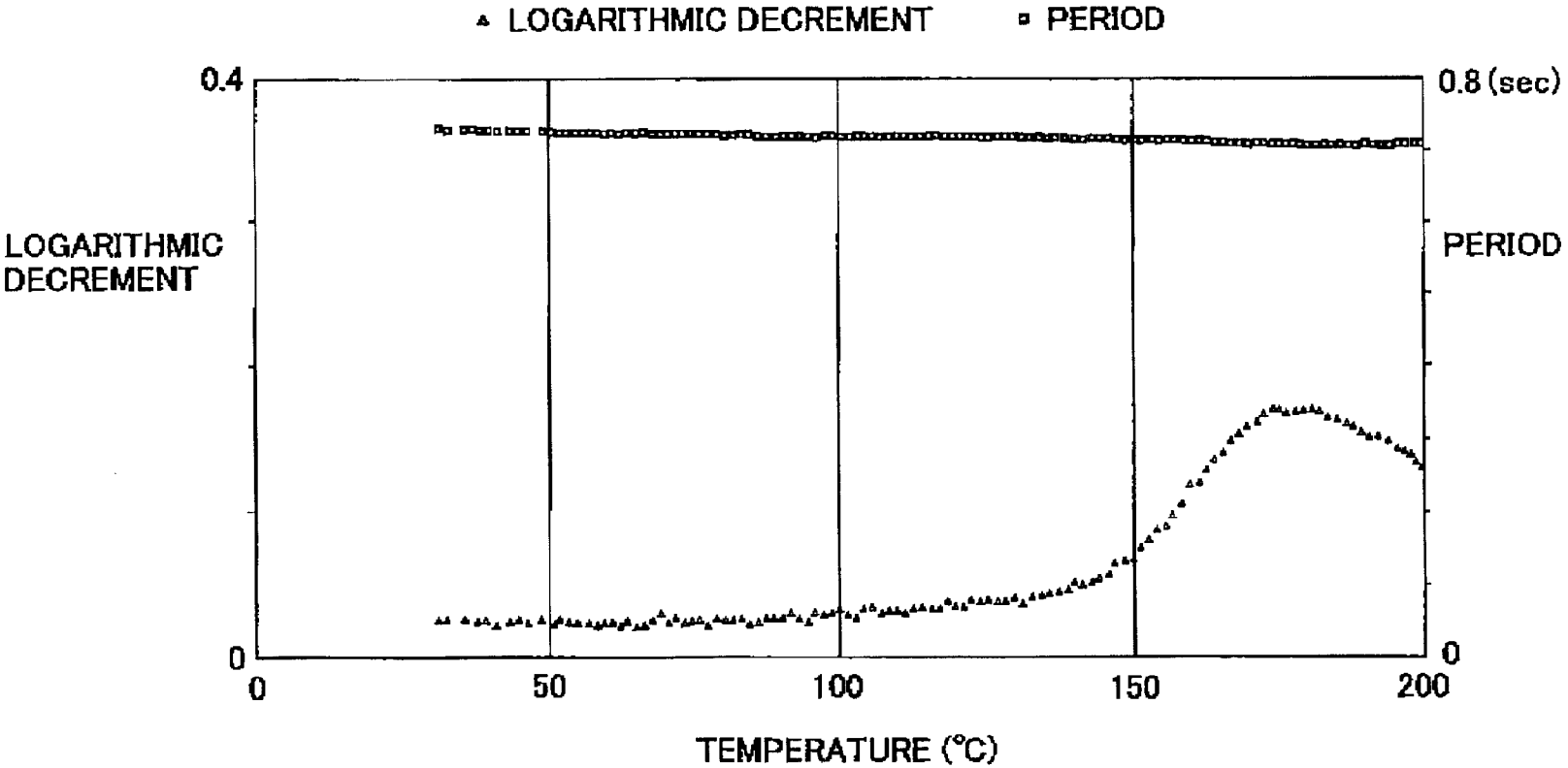
FIG. 2 is a graph illustrating the relationship between the temperature of the reversible thermosensitive recording medium of Example 5 and the viscoelastic logarithmic decrement thereof.
Figure 3:
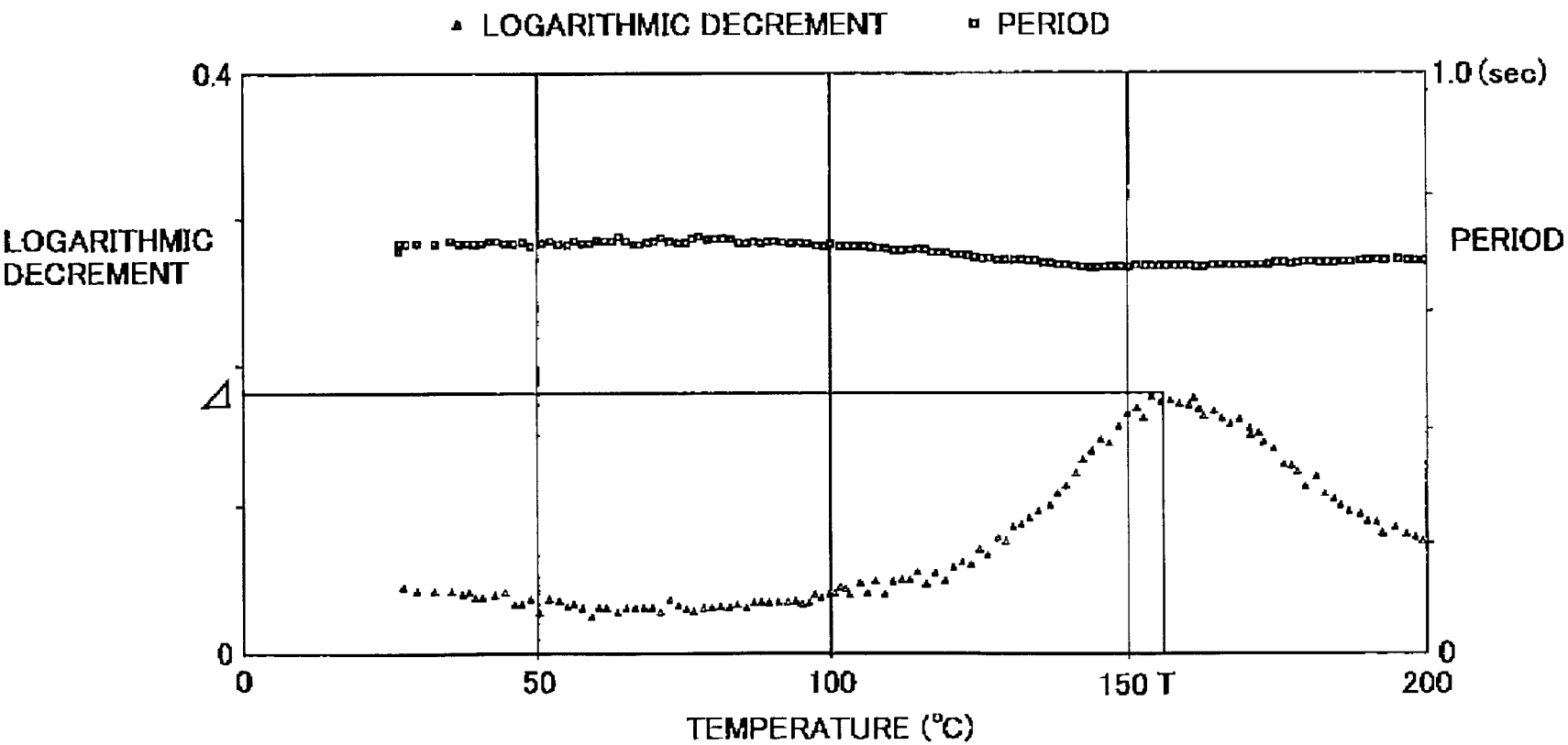
FIG. 3 is a graph illustrating the relationship between the temperature of the reversible thermosensitive recording medium of Example 6 and the viscoelastic logarithmic decrement thereof.

The logarithmic decrement of a layer measured by a rigid pendulum automatic damped vibration method means the viscoelastic property of the layer. The logarithmic decrement of a layer can be determined by analyzing the free damped vibration amplitude of a rigid pendulum contacted with the layer which is heated from room temperature to about 200° C. to measure the viscoelasticity of the layer in a glass state and a rubber state. In FIGS. 2 and 3, the peak temperature T at which the logarithmic decrement $\Delta$ maximizes means the glass transition temperature (Tg) of the layer at which the layer changes its state from the glass state to the rubber state. In addition, the logarithmic decrement represents the degree of the inflexibility of the layer. Namely, the less the logarithmic decrement of a layer, the more inflexible the layer. When the physical and/or chemical interactions of the constituents of a layer become strong, the thermal motion of the constituents is limited, and therefore the layer has a low logarithmic decrement i.e., the layer is rigid.

In addition, the higher the peak temperature T, the more inflexible the main chain of the layer.

Hereinafter the reversible thermosensitive recording medium of the present invention will be explained in detail.

In the present invention, the recording layer serves as the crosslinked polymer layer. However, it is especially preferable that a protective layer is formed on the recording layer as the crosslinked polymer layer. Namely, it is preferable to include a crosslinked polymer having an ultraviolet absorbing structure as a constituent of the protective layer.

When the crosslinked polymer layer is the protective layer, at least one of the recording layer and an intermediate layer which is optionally formed between the protective layer and the recording layer may also be a crosslinked polymer layer.

When the crosslinked polymer layer is the protective layer and/or the recording layer, the polymer having an ultraviolet absorbing structure can be used alone or in combination with another polymer in the layer or layers.

In the present invention, polymers having an ultraviolet absorbing structure are defined as polymers including a group, which can absorb ultraviolet rays, in their molecules. Specific examples of the ultraviolet absorbing structure include a salicylate structure, a cyano acrylate structure, a benzotriazole structure, a benzophenone structure, etc. In particular, resins having a benzotriazole structure or a benzophenone structure are preferably used because of having good light resistance.

In addition, it is preferable to use a hardener to crosslink the polymer having an ultraviolet absorbing structure.

Therefore, it is preferable that the polymer having an ultraviolet absorbing structure has a group capable of reacting with a hardener, such as a hydroxyl group, an amino group, a carboxyl group, etc. In particular, polymers having a hydroxyl group are preferably used. In addition, polymers having not less than 10 hydroxyl groups are more preferable because the resultant polymer layer has good film strength.

Suitable hardeners for use in the present invention include hardeners which can react with a resin to form a crosslinked resin. Among these hardeners, isocyanate type hardeners are especially preferable. A hardener is added in an amount such that the resultant recording medium has a desired durability. In general, the ratio (Na/Nh) of the number (Na) of an active group of the hardener used to the number (Nh) of hydroxyl group of the polymer used is preferably from 0.3 to 2.0, and more preferably from 0.8 to 1.5. When the ratio is not less than 0.3, the resultant polymer layer has a high heat strength (i.e., a high durability). In addition, when the ratio is not greater than 2.0, the resultant recording medium has good color forming/erasing properties.

In the present invention, the main chain of the crosslinked polymer is preferably an acrylic chain or a polyester chain. This is because it is easy to enhance the film strength and heat resistance of the resultant crosslinked polymer layer by increasing the number of crosslinking points by increasing the hydroxyl value of the polymer used; or copolymerizing a monomer which has a high glass transition temperature (Tg) when polymerizing the polymer to be used. In addition, the polymers have advantages such that the production amount of such polymers is very large and the cost thereof is relatively low.

The molecular weight of the polymer having an ultraviolet absorbing structure is not particularly limited as long as the polymer can form a film. However, the weight average molecular weight of the polymer, which is determined by a gel permeation chromatography method, is preferably not less than 10,000, and more preferably not less than 11,000 in order to shorten the curing time and improve the surface hardness of the resultant polymer layer.

In the present invention, the hardness and softness of a layer is represented by logarithmic decrement thereof, which is measured by a rigid pendulum automatic damped vibration method. The less the logarithmic decrement of a layer, the higher the crosslinking density (i.e., the more inflexible the layer). In addition, the peak temperature of a logarithmic decrement curve of a polymer represents the glass transition temperature (Tg) of the polymer. By increasing the glass transition temperature of a polymer, the inflexibility of the main chain of the polymer is enhanced and that the temperature at which the polymer changes a state from a glass state to a rubber state is heightened.

As mentioned above, in order to improve the durability of a reversible thermosensitive recording medium, it is preferable that a crosslinked polymer layer having an ultraviolet absorbing structure is formed, and in addition the layer has a high glass transition temperature if the layer is soft, or the layer may have inflexibility if the layer has relatively low glass transition temperature.

Namely, it is preferable that the crosslinked polymer layer has a viscoelastic property such that the peak temperature is not lower than 100° C. and the logarithmic decrement is not greater than 0.3; or the peak temperature is not lower than 150° C. and the logarithmic decrement is not greater than 0.6.

Next, the polymer having an ultraviolet absorbing structure for use in the reversible thermosensitive recording medium will be explained in detail.

The polymer having an ultraviolet absorbing structure has a skeleton which is typically obtained by copolymerizing a monomer having an ultraviolet absorbing group with a monomer having a functional group. The polymer is may be linear polymers, branched polymers having a long side chain, branched polymers having a short side chain, star polymers, comb polymers, arborized polymers, ring polymers, etc. If the polymer is a copolymer, the copolymer may be any one of block copolymers, graft copolymers, star copolymers, or random copolymers. In particular, block copolymers and graft copolymers are preferably used.

Suitable monomers for use in the polymer having an ultraviolet absorbing structure include the following compounds having a benzotriazole moiety.

2-(2'-hydroxy-5'-methacryloxyethylphenyl)-2H-benzotriazole,
2-(2-hydroxy-5'-methylphenyl)benzotriazole,
2-(2'-hydroxy-5'-t-butylphenyl)benzotriazole,
2-(2'-hydroxy-3'-t-butyl-5'-methylphenyl)benzotriazole,
2-(2'-hydroxy-3'-t-butyl-5'-methylphenyl)-5-chlorobenzotriazole,
2-(2'-hydroxy-3',5'-di-t-butylphenyl)-5-chlorobenzotriazole,
2-(2'-hydroxy-5'-t-butylphenyl)-5-chlorobenzotriazole,
2-(2'-hydroxy-3',5'-di-t-butylphenyl)benzotriazole,
2-(2'-hydroxy-3',5'-di-t-aminophenyl)benzotriazole,
2-(2'-hydroxy-5'-t-octyphenyl)benzotriazole,
2-(2'-hydroxy-3',5'-di-t-pentylphenyl)benzotriazole,
2-{2'-hydroxy-3'-(3",4",5",6"-tetrahydrophthalimidemethyl)-5'-methylphenyl}benzotriazole,
2-{2'-hydroxy-3',5'-bis(α,α-diethylbenzyl)phenyl}-2H-benzotriazole,
2-(2'-hydroxy-3'-eudodecyl-5'-methylphenyl)benzotriazole,
2-(5'-methyl-2'-hydroxyphenyl)benzotriazole,
2-{2'-hydroxy-3',5'-bis(α,α-dimethylbenzyl)phenyl}-2H-benzotriazole,
2-(3,5-di-t-butyl-2-hydroxyphenyl)benzotriazole,
2-(3-t-butyl-5-methyl-2-hydroxyphenyl)-5-chlorobenzotriazole,
2-(3,5-di-t-butyl-2-hydroxyphenyl)-5-chlorobenzotriazole,
2-(3,5-di-t-amyl-2-hydroxyphenyl)benzotriazole,
2-(2'-hydroxy-5'-t-octylphenyl)benzotriazole,
2-(5-t-butyl-2-hydroxyphenyl)benzotriazole,
2-(5-t-octyl-2-hydroxyphenyl)benzotriazole,
2-(2'-hydroxy-3'-dodecyl-5'-methylphenyl)benzotriazole,
2-(2'-hydroxy-3'-undecyl-5'-methyphenyl)benzotriazole,
2-(2'-hydroxy-3'-tridecyl-5'-methylphenyl)benzotriazole,
2-(2'-hydroxy-3'-tetradecyl-5'-methylphenyl)benzotriazole,
2-(2'-hydroxy-3'-pentadecyl-5'-methylphenyl)benzotriazole,
2-(2'-hydroxy-3'-hexadecyl-5'-methylphenyl)benzotriazole,
2-{2'-hydroxy-4'-(2"-ethylhexyl)oxyphenyl}benzotriazole,
2-{2'-hydroxy-4'-(2"-ethylheptyl)oxyphenyl}benzotriazole,
2-{2'-hydroxy-4'-(2"-ethyloctyl)oxyphenyl}benzotriazole,
2-{2'-hydroxy-4'-(2"-propylhexyl) oxyphenyl}benzotriazole,
2-{2'-hydroxy-4'-(2"-propylheptyl) oxyphenyl}benzotriazole,
2-{2'-hydroxy-4'-(2"-propyloctyl)oxyphenyl}benzotriazole,
2-{2'-hydroxy-4'-(1"-ethylhexyl)oxyphenyl}benzotriazole,
2-{2'-hydroxy-4'-(1"-ethylheptyl)oxyphenyl}benzotriazole,
2-{2'-hydroxy-4'-(1"-ethyloctyl)oxyphenyl}benzotriazole,
2-{2'-hydroxy-4'-(1"-propylhexyl) oxyphenyl}benzotriazole,
2-{2'-hydroxy-4'-(1"-propylheptyl) oxyphenyl}benzotriazole,
2-{2'-hydroxy-4'-(1"-propyloctyl)oxyphenyl}benzotriazole,
etc.

Among these compounds, 2-(2'-hydroxy-5'-methacryloxyethylphenyl)-2H-benzotriazole, 2-(2'- hydroxy-5'-methylphenyl)benzotriazole, and 2-(2'-hydroxy-3'-t-butyl-5'-methylphenyl)-5-chlorobenzotriazole are preferably used.

Specific examples of the monomers having a benzophenone group include:

2-hydroxybenzophenone,
2,4-dihydroxybenzophenone,
2-hydroxy-4-methoxybenzophenone,
2-hydroxy-4-n-octoxybenzophenone,
2-hydroxy-4-n-octyloxybenzophenone,
2-hydroxy-4-n-dodecyloxybenzophenone,
2,2'-dihydroxy-4-methoxybenzophenone,
2,2'-dihydroxy-4,4'-dimethoxybenzophenone,
2,2',4,4'-tetrahydroxybenzophenone,
2-hydroxy-4-methoxy-2'-carboxybenzophenone,
2-hydroxy-4-oxybenzylbenzophenone,
2-hydroxy-4-chlorobenzophenone,
2-hydroxy-4-methoxy-5-sulfobenzophenone,
2-hydroxy-4-methoxybenzophenone-5-sulfonic acid sodium salt,
2,2'-dihydroxy-4,4'-dimethoxybenzophenone-sulfonic acid sodium salt, etc.

Among these compounds, 2,2',4,4'-tetrahydroxybenzophenone is preferably used.

Specific examples of the monomers having a functional group for use in the present invention include:

2-isopropenyl-2-oxazoline,
2-aziridinylethyl (meth)acrylate,
methacrylic acid,
glycidyl (meth)acrylate,
hydroxyethyl (meth)acrylate,
hydroxypropyl (meth)acrylate,
dimethylaminoethyl (meth)crylate,
diethylaminoethyl (meth)crylate,
t-butylaminoethyl (meth)acrylate,
tetrahydrofurfuryl (meth)acrylate, etc.

Among these compounds, hydroxyethyl (meth)acrylate and hydroxypropyl (meth)acrylate are preferably used.

In order to prepare a polymer layer having high strength and heat resistance, the monomers having an ultraviolet absorbing group and the monomers having a functional group may be copolymerized with the following monomers:

Monomers such as styrene, styrene-butadiene, styrene-isobutylene, ethylene-vinyl acetate, vinyl acetate, methacrylonitrile, vinyl alcohol, vinyl pyrrolidone and (meth)acrylonitrile; (meth)acrylate monomers such as acrylic acid, methyl (meth)acrylate, ethyl(meth)acrylate, propyl (meth)acrylate, butyl (meth)acrylate, isobutyl (meth) acrylate, t-butyl (meth)acrylate, ethylhexyl (meth)acrylate, ocotyl (meth)acrylate, isodecyl (meth)acrylate, lauryl (meth) acrylate, lauryltridecyl (meth)acrylate, tridecyl (meth) acrylate, cetylstearyl (meth)acrylate, stearyl (meth)acrylate, cyclohexyl (meth)acrylate and benzyl (meth)acrylate; monomers having two or more polymerizable double bonds in their main chain, such as ethylene di(meth)acrylate, diethylene glycol di(meth)acrylate, triethylene glycol di(meth)acrylate, tetraethylene glycol di(meth)acrylate, decaethylene glycol di(meth)acrylate, pentacontahectaethylene glycol (meth)acrylate, butylene di(meth)acrylate, pentaerythritol tetra(meth)acrylate, trimethylolpropane tri (meth)acrylate, pentadecaethylene glycol di(meth)acrylate, di(meth)acrylate esters of diethyleneglycol phthalate; etc.

Among these monomers, styrene, methyl (meth)acrylate, ethyl (meth)acrylate, propyl (meth)acrylate, butyl (meth) acrylate, isobutyl (meth)acrylate and t-butyl (meth)acrylate are preferably used. One or more of these monomers can be copolymerized with the monomers having an ultraviolet absorbing group and the monomers having a functional group.

Suitable polymers having an ultraviolet absorbing structure for use in the present invention include copolymers prepared by copolymerizing 2-(2'-hydroxy-5'-methacryloxyethylphenyl)-2H-benzotriazole, 2-hydroxyethyl methacrylate and styrene; copolymers prepared by copolymerizing 2-(2'-hydroxy-5'-methylphenyl) benzotriazole, 2-hydroxypropyl methacrylate and methyl methacrylate; copolymers prepared by copolymerizing 2-(2'-hydroxy-3'-t-butyl-5'-methylphenyl)-5-chlorobenzotriazole, 2-hydroxyethyl methacrylate and t-butyl methacrylate; and copolymers prepared by copolymerizing 2,2',4,4'-tetrahydroxybenzophenone, 2-hydroxypropyl methacrylate, styrene, methyl methacrylate and propyl methacrylate. However, the polymer having an ultraviolet absorbing structure is not limited thereto.

As the hardeners for use in the present invention, isocyanate hardeners, aziridine hardeners, epoxy hardeners, melamine hardeners, oxazoline hardeners, carbodiimido hardeners, etc. can be used. Among these compounds, isocyanate hardeners can be preferably used.

Suitable isocyanate hardeners for use in the present invention include polyisocyanate compounds having plural isocyanate groups. Specific examples of the polyisocyanate compounds include hexamethylene diisocyanate (HDI), tolylene diisocyanate (TDI), xylylene diisocyanate (XDI), isophorone diisocyanate (IPDI), etc. In addition, adducts of these isocyanate compounds with trimethylol propane and the like, buret type compounds of these isocyanate compounds, isocyanurate type compounds of these isocyanate compounds and blocked isocyanate compounds of these isocyanate compounds can also be used.

Among these isocyanate compounds, hexamethylene diisocyanate is preferable, and its adduct type, buret type and isocyanurate type are preferably used. All the amount of an isocyanate compound added are necessarily reacted with monomers to form a crosslinked polymer layer. Namely, the ioscyanate compound added may be present in the crosslinked polymer layer while not being reacted with the monomers used. This crosslinking reaction proceeds with lapse of time. Therefore, existence of a certain amount of a hardener, which is not reacted, does not mean that the crosslinking reaction does not proceed at all, but suggests that a crosslinked resin is present.

A catalyst for use in such a kind of reaction can be used as a crosslinking promoter in the present invention. Specific examples of such a crosslinking promoter include tertiary amines such as 1,4-diaza-bicyclo[2,2,2]octane; metal compounds such as organic tin compounds.

In the present invention, whether the polymer having an ultraviolet absorbing structure is crosslinked or not can be determined by a method in which the resultant polymer layer is dipped in a solvent having high dissolving ability. Specifically, when a non-crosslinked polymer is present, the polymer dissolves into the solvent, and does not remain in the solid component. Then the ultraviolet absorbing structure of the solid component is analyzed to determine whether the polymer having an ultraviolet absorbing structure is crosslinked or not. Namely, it can be said that if the ultraviolet absorbing structure is not found, the polymer having the ultraviolet absorbing structure is not crosslinked. Thus, a non-crosslinked polymer can be distinguished from a crosslinked polymer having an ultraviolet absorbing structure.

If another layer is overlaid, the cross section of the recording medium to be examined is observed using a transmittance electron microscope (TEM) or a scanning electron microscope (SEM) to determine the layer structure thereof. Then the ultraviolet absorbing layer is identified by analyzing the components of each of the layers. If there is a layer or layers overlaid on the layer having an ultraviolet absorbing structure, they are removed by a scraping method or the like method to disclose the layer having an ultraviolet absorbing structure. Then the layer is scraped to be subjected to the above-mentioned analysis.

In the present invention, viscoelastic logarithmic decrement can be measured by a rigid pendulum automatic damped vibration method. The measurement method is as follows:

Instruments Used

A rigid body type physical property tester RPT-3000 manufactured by A and D Company, Limited.

Rigid Pendulum Used

A combination of a rod type cylinder edge RBP-040 with a rigid pendulum FRB-100.

Preparation of Sample

A reversible thermosensitive recording medium sample is cut to prepare a sheet of 20 mm in width and 25 mm in length. If the crosslinked polymer layer is a protective layer, other layers such as the recording layer and intermediate layer, which are formed under the crosslinked polymer layer, need not to be removed.

When one or more layers are formed on the crosslinked polymer layer, the layer or layers are scraped to disclose the crosslinked polymer layer.

Procedure for Measurements

The sample is set on a heating/cooling block. The cylinder edge RBP-040 is set on the surface of the sample. Then the pendulum is vibrated while the sample is heated from 25° C. to 200° C. at a heating speed of 9° C./min.

Analysis

The free vibration period and vibration amplitude of the pendulum are analyzed to determine the logarithmic decrement at each of the measurement temperatures. Then the logarithmic decrement at each of the measurement temperatures is plotted to record a logarithmic decrement curve. At this point, the temperature at which the logarithmic decrement is maximal is defined as the peak temperature. In addition, the logarithmic decrement at this temperature is defined as the logarithmic decrement at the peak temperature.

Next, the way to attain the second object will be explained in detail.

The present inventors have investigated to improve writability, and fixability and erasability of the written images written by a writing material such as marker pens. As a result, it is found that the dynamic receding contact angle of the surface layer of a reversible thermosensitive recording medium largely influences on these characteristics. Specifically, when the dynamic receding contact angle of the surface layer against water is from 75° to 100°, the surface layer has good combination of writabilily, fixability and erasability when an image is written thereon by a marker pen.

When the dynamic receding contact angle is not less than 75°, the surface layer has good combination of writability and fixability. In addition, the written image can be erased relatively easily without a residue of the written image. When the dynamic receding contact angle is not greater than 100°, images can be clearly written by a marker pen without repelling the ink of the marker pen.

In the present invention, the materials constituting the surface layer are not particularly limited as long as the surface layer has a dynamic receding contact angle of from 75° to 100°. Namely, the dynamic receding contact angle of the surface layer should be controlled by properly selecting materials, adjusting the formulation and controlling the surface conditions such as roughness.

The reversible thermosensitive layer may be constituted of only a recording layer. In addition, a protective layer, and an intermediate layer can be optionally formed on the recording layer, and between the protective layer and the recording layer, respectively. If the recording layer is the surface layer, the recording layer preferably has a dynamic receding contact angle of from 75° to 100°. If a protective layer is formed as a surface layer, the protective layer preferably has a dynamic receding contact angle of from 75° to 100°. In the present invention, it is preferable to form a protective layer as a surface layer.

The marker pen by which an image is written on the reversible thermosensitive recording medium is not particularly limited, however, markers including an alcohol type ink are preferably used to bring out the good writability of the recording medium of the present invention.

The dynamic receding contact angle is influenced by the hydrophilicity/lipophilicity of the surface layer and the surface conditions thereof such as profile of the surface. The hydrophilicity/lipophilicity of the surface layer can be changed by changing the resin used or by adding an additive such as silicone oils. When an additive having a low molecular weight is added, a problem such that the surface properties are deteriorated by migration of the additive into the recording layer or precipitation of the additive on the surface of the surface layer often occurs.

According to the present invention, by using a silicone-modified polymer, such a problem as mentioned above can be avoided.

Suitable silicone-modified polymers for use in the surface layer include silicone graft polymers, silicone block polymers, silicone-modified acrylic polymers, silicone-modified polyvinyl alcohols, etc. Among these polymers, silicone graft polymers are especially preferable. Specific examples of silicone graft polymers include silicone-grafted acrylic polymers, silicone-grafted polyvinyl alcohols, etc. Among these polymers, polymers which can be crosslinked by heating are especially preferable.

As mentioned above, the recording medium of the present invention includes a crosslinked polymer layer having an ultraviolet absorbing structure. When the surface layer is the crosslinked polymer layer having an ultraviolet absorbing structure, it is preferable to crosslink a combination of a crosslinkable polymer having an ultraviolet absorbing structure with a crosslinkable silicone-modified polymer.

The dynamic receding contact angle of the surface layer can be controlled by including a filler in the surface layer. Suitable fillers include known organic fillers and inorganic fillers.

Specific examples of the organic fillers include silicone resin fillers, fluorine-containing resin fillers, acrylic resin fillers, polyamide resin fillers, epoxy resin fillers, thermally-crosslinked hollow resin fillers, polyethylene waxes, shellac, wood flour, cork powders, etc.

Specific examples of the inorganic fillers include metal oxides such as silica, alumina, zinc oxide, indium oxide, zirconium oxide, tin oxide, cerium oxide, iron oxide, antimony oxide, barium oxide, calcium oxide, bismuth oxide, nickel oxide, magnesium oxide, chromium oxide, manganese oxide, tantalum oxide, niobium oxide, thorium oxide, hafnium oxide, molybdenum oxide, iron ferrite, nickel ferrite, cobalt ferrite, barium titanate and potassium titanate; carbonates such as calcium carbonate and magnesium carbonate; silicates such as silicic anhydride, hydrous silicic acid, hydrated aluminum silicate and hydrated calcium silicate; hydroxides such as aluminum hydroxide and iron hydroxide; sulfides and sulfates such as zinc sulfide and barium sulfate; metal carbides such as titanium carbide, silicon carbide, molybdenum carbide, tungsten carbide and tantalum carbide; metal nitrides such as aluminum nitride, silicon nitride, boron nitride, zirconium nitride, vanadium nitride, titanium nitride, niobium nitride and gallium nitride; talc, kaolin, clay, etc.

In view of durability, inorganic fillers are preferably used. Among the inorganic fillers, inorganic fillers which are coated with a calcium compound and inorganic complex compounds including a calcium compound are preferably used.

These fillers can be used alone or in combination.

A filler is included in the surface layer while dispersed therein. The surface conditions of the surface layer change depending on the particle diameter of the filler. When the filler has too small a particle diameter, the effect of addition of the filler is not exhibited. To the contrary, when the filler has too large a particle diameter, the erasability of an image written by a marker pen deteriorates because the ink of the marker pen present in recesses is hardly removed. Therefore, the filler preferably has a particle diameter of from 0.2 to 2 $\mu$m, and more preferably from 0.4 to 1 $\mu$m.

In the present invention, the eraser by which an image written by a marker pen is erased is not particularly limited. However, non-woven cloths, sponges, paper cotton cloths and synthetic resins having a cylindrical, roll, rod or blade shape can be preferably used. When a written image is erased, a washing liquid may be used and/or heat may be applied thereto. The eraser may be united with or separated from an image erasure/formation device by which an image recorded in the recording layer is erased and then another is image recorded in the recording layer. Preferably the eraser is united with an image erasure/formation device, and an image is preferably recorded in the recording layer after the image written by a marker pen is erased by the eraser.

In order not to deteriorate the image qualities of images recorded in the recording layer, the image written by a marker pen should be clearly erased without a residue thereof. The reversible thermosensitive recording medium of the present invention not only fulfills such a requirement but also has good writability when an image is written on the surface by a marker pen. Until now such a recording material has not been developed.

The reversible thermosensitive recording medium of the present invention includes a leuco dye in the reversible thermosensitive recording layer. As the leuco dye, known leuco compounds such as dye precursors of phthalide compounds, azaphthalide compounds, fluoran compounds, etc., can be used. Specific examples of the leuco dyes include leuco dyes disclosed in Japanese laid-Open Patent Publications Nos. 5-124360, 6-210954 and 10-230680 incorporated herein by reference.

Among these leuco dyes, the following compounds are preferable:

2-anilino-3-methyl-6-diethylaminofluoran,
2-anilino-3-methyl-6-di(butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-ethyl-p-toluidino)fluoran,
3-(1-ethyl-2-methylindole-3-yl)-3-(2-ethoxy-4-diethylaminophenyl)-4-azaphthalide,
3-(1-ethyl-2-methylindole-3-yl)-3-(2-ethoxy-4-diethylaminophenyl)-7-azaphthalide, etc.

As the color developer which is included in the recording layer, the color developers disclosed in Japanese laid-Open Patent Publications Nos. 5-124360, 6-210954 and 10-230680 incorporated herein by reference, can be typically used. Namely, compounds which have both a structure capable of making a leuco dye color, such as a phenolic hydroxyl group, a carboxyl group and a phosphate group, and a structure capable of controlling cohesive force, such as long chain hydrocarbon groups. A group having a hetero atom and two or more valence may be intervened between the two structures. In addition, the long chain hydrocarbon group may include a group having a hetero atom and/or an aromatic group. Color developers disclosed in Japanese Laid-Open Patent Publications Nos. 9-290563, 11-188969 and 11-99749 incorporated herein by reference can also be used in the present invention.

Among these color developers, N-(4-hydroxyphenyl)-N'-octadecylurea, N-{11-(p-hydroxyphenyl)undecano-N'-n-decanohydrazide, N-{3-(p-hydroxyphenyl)propiono-N'-n-docosanohydrazide, etc., can be especially preferable.

The mole ratio (D/C) of the color developer (D) to the coloring agent (i.e., leuco dye) (C) in the recording layer is preferably from 0.1 to 20, and more preferably from 0.2 to 10. When the content of the color developer is too low or too high, the image density of recorded images decreases.

The coloring agent and/or color developer can be used while being microencapsulated.

The recording layer optionally includes an additive for improving coating properties and/or coloring/erasing properties. As such an additive, for example, surfactants, electroconductive agents, fillers, antioxidants, color formation stabilizers, color erasure promoters, and coloring/erasing controlling agents can be used.

Suitable coloring/erasing controlling agents include compounds having both a divalent group including a hetero atom, such as an amide group and a urea group, and an alkyl group having not less than 8 carbon atoms; compounds having an amide group whose nitrogen atom has two substituents; etc. However, in the present invention, the coloring/erasing controlling agent is not limited thereto.

Then the color formation and erasure mechanism will be explained.

Figure 1:
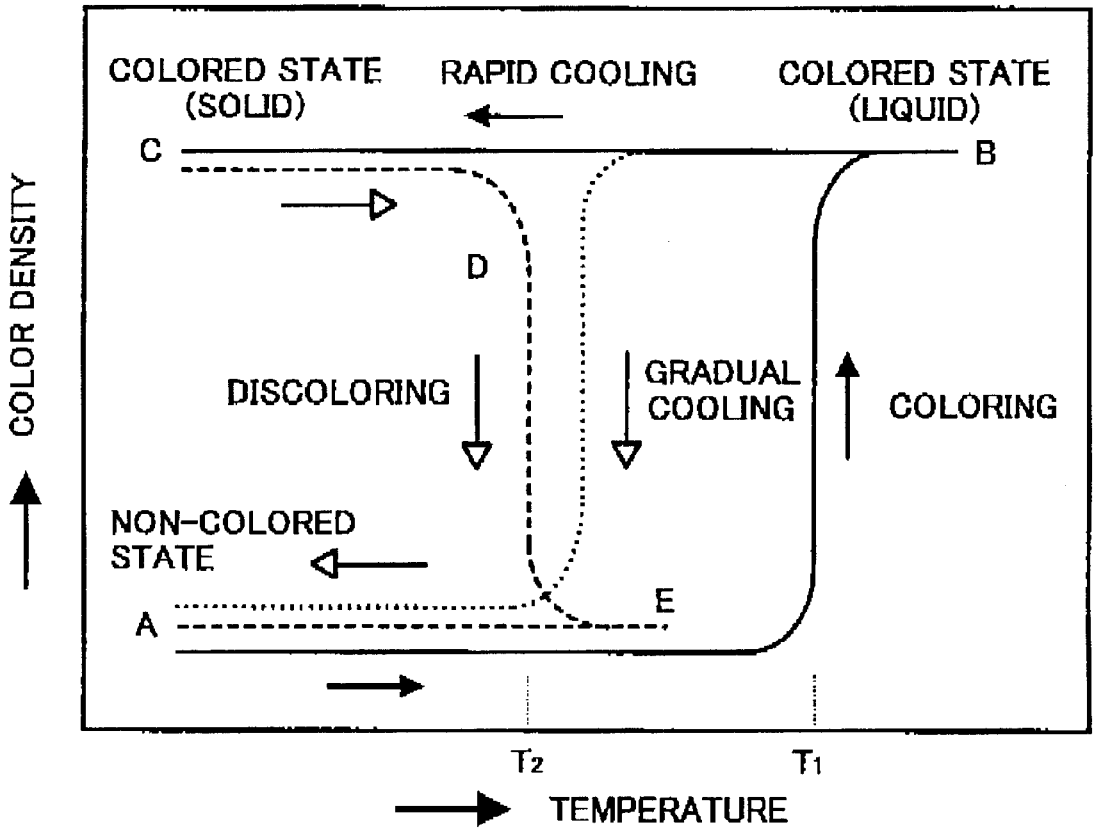
FIG. 1 is a schematic view illustrating the image forming/erasing properties of an embodiment of the reversible thermosensitive recording medium of the present invention.

FIG. 1 is a graph illustrating the relationship between temperature of a reversible thermosensitive recording material (hereinafter a recording material) and image density thereof. When the recording material which is in a non-colored state A is heated, the recording material begins to color at an image forming temperature T1 in which at least one of an electron donating coloring agent and an electron accepting coloring developer is melted and then achieves a melted colored state B. If the recording material in the melted colored state B is rapidly cooled to room temperature, the recording material keeps the colored state and achieves a cooled colored state C in which the electron donating coloring agent and the electron accepting color developer are almost solidified. It depends upon cooling speed whether the recording material remains in the colored state, and if the recording material is gradually cooled, the recording material returns to the non-colored state A (a dotted line B-A) or achieves a semi-colored state in which the image density of the recording material is relatively low compared to the image density of the recording material in the cooled colored state C. If the recording material in the cooled colored state C is heated again, the recording material begins to discolor at an image erasing temperature T2 lower than T1 and achieves a non-colored state E (a broken line C-D-E). If the recording material in the non-colored state E is cooled to room temperature, the recording material returns to the non-colored state A. The temperatures T1 and T2 depend on the materials of the coloring agent and the color developer. Accordingly, by appropriately selecting a coloring agent and a color developer, a recording material having desired T1 and T2 can be obtained. The image densities of the recording material in the colored states B and C are not necessarily the same.

Within the context of the present invention, the term "relatively slow" as it relates to the difference between the second cooling speed and first cooling speed, means that the second cooling speed is sufficiently slow to permit the recording layer to return from the colored state to the non-colored state. This speed is slow relative to the first cooling speed, since the first cooling speed cools the recording layer quickly enough to retain the colored state.

In order to form a colored image in the recording layer of the recording medium of the present invention, the recording layer is merely heated, for example, by a thermal printhead to a temperature at which the leuco dye and color developer melt and mix, and then rapidly cooled. In order to erase the colored image, there are two ways. One of the ways is to gradually cool the heated recording layer. The other way is to heat the recording layer to a temperature slightly lower than the image forming temperature. Whichever way we select, the recording layer performs the same image erasing process. Namely, the temperature of the recording layer is maintained at a temperature at which the phase of the coloring agent is separated from the phase of the color developer or at least one of the coloring agent and the color developer crystallizes. Thus, the color image is erased.

As mentioned above, the recording layer is rapidly cooled after heating when a color image is formed. This is because the temperature of the recording layer is not maintained at the phase separation temperature or the crystallization temperature. At this point, the speeds of rapid cooling and gradual cooling depend on the composition of the coloring agent and color developer used, and the boundary thereof changes depending on the composition.

As the resin in the recording layer, polymers having an ultraviolet absorbing structure are preferably used. In addition, known resins can be used. Among known resins, crosslinkable resins are preferably used in view of durability of the resultant recording layer. Suitable crosslinkable resins include heat crosslinking resins, ultraviolet crosslinking resins, electron beam crosslinking resins, etc. Among these crosslinking resins, heat crosslinking resins are preferably used. In particular, crosslinked resins which are prepared by heat-crosslinking a combination of a resin having a hydroxyl group with an isocyanate crosslinking agent are especially preferable. For example, as disclosed in 10-230680, combinations of an acrylic polymer, a styrene polymer or a polyester which has a hydroxyl group with a crosslinking agent are preferable. These resins are used alone or in combination with a polymer having an ultraviolet absorbing structure.

The ratio (R/C) of the resin (R) to the coloring components (i.e., a leuco dye and a color developer) (C) in the recording layer is preferably from 0.1 to 10 by weight. When the ratio is too small, the resultant recording layer has poor heat strength. To the contrary, when the ratio is too large, the color density of the resultant recording medium decreases.

The recording layer can be formed by coating a coating liquid in which a color developer, a coloring agent, and a binder, and optionally an additive, are mixed and dispersed in a solvent. Specific examples of the solvents include water; alcohols such as methanol and isopropanol; ketones such as acetone, 2-butanone, ethyl amyl ketone and cyclohexanone; esters such as methyl acetate, ethyl acetate, isobutyl acetate and amyl acetate; aromatic hydrocarbons such as toluene and xylene; amides; ethers, glycoletheracetate; aliphatic hydrocarbons; halogenated hydrocarbons; sufoxides; pyrrolidones; etc.

When an isocyanate crosslinking agent is used, ketones, esters and aromatic hydrocarbons can be preferably used.

The coating liquid can be prepared using a paint shaker, a ball mill, an attritor, a three-roll mill, a sand mill or the like dispersing machine. The components mentioned above may be dispersed in a solvent at the same time or each dispersion of the components may be mixed to prepare the coating liquid. In addition, when preparing a dispersion, the component mixture may be heated and then cooled to precipitate the components from a solvent.

The coating method is not particularly limited, and known coating methods such as die coating, blade coating, wire bar coating, spray coating, air knife coating, bead coating, curtain coating, gravure coating, kiss coating, reverse roll coating and dip coating can be used.

The recording medium of the present invention may include a protective layer on the recording layer. In addition, an intermediate layer may be formed between the recording layer and the protective layer. The purposes of forming an intermediate layer are as follows:

(1) to improve the adhesion of the protective layer with the recording layer;

(2) to prevent the recording layer from being damaged due to coating of the protective layer coating liquid; and (3) to prevent the materials of the recording layer from migrating into the protective layer.

The resins for use in the intermediate layer include the resins mentioned above for use in the recording layer. The resins can be used alone or in combination. Of course, a polymer having an ultraviolet absorbing structure may also be used for the intermediate layer. As the crosslinking agent, the crosslinking agents mentioned above for use in the recording layer can also be used for the intermediate layer.

The thickness of the intermediate layer is preferably from 0.1 to 20 $\mu$m, and more preferably from 0.3 to 10 $\mu$m. The solvents, the dispersing machines and the coating methods mentioned above for use in formation of the recording layer can also be used for formation of the intermediate layer.

The protective layer mainly includes a resin. Suitable resins for use in the protective layer include heat crosslinking resins, ultraviolet crosslinking resins, electron beam crosslinking resins, etc. When the protective layer serves as a crosslinked polymer layer, it is needed to use a polymer having an ultraviolet absorbing structure.

The recording medium may include an undercoat layer between the substrate and the recording layer to effectively utilize heat applied for recording images, to obtain good adhesion of the recording layer with the substrate and/or to prevent the substrate from deteriorating due to contact with the recording layer coating liquid. The undercoat layer can be formed, for example, by coating a coating liquid in which micro hollow particles are dispersed in a binder resin. As the resin, the resins mentioned above for use in the recording layer, and polymers having an ultraviolet absorbing structure can be used alone or in combination.

The recording medium of the present invention may include a back layer on the side of the substrate opposite to the recording layer, to improve feeding properties of the resultant recording medium. The back layer mainly includes a resin. Suitable resins for use in the back layer include the resins mentioned above for use in the undercoat layer.

The recording layer, intermediate layer, protective layer, undercoat layer and back layer optionally include a filler. Suitable fillers for use in these layers include inorganic fillers and organic fillers. Specific examples of the inorganic fillers include calcium carbonate, silica, aluminum hydroxide, etc. Specific examples of the organic fillers include silicone resins. The shape of the fillers is not particularly limited, and any particles having a spherical shape, a plate shape, a needle shape or the like can be used.

The recording layer, intermediate layer, protective layer, undercoat layer and back layer optionally include a lubricant. Specific examples of the lubricants include synthetic waxes, vegetable waxes, animal waxes, higher alcohols, higher fatty acids, higher fatty acid esters, amides, etc.

When the recording layer, intermediate layer, protective layer, undercoat layer and back layer are coated, the coated layers are dried, and then crosslinked if desired. The crosslinking treatment is performed at a high temperature for a short time, or at a low temperature for a long time. Specifically the crosslinking conditions are performed at a temperature of from 30 to 130° C. for 1 minute to 150 hours, and preferably at a temperature of from 40 to 100° C. for 2 minutes to 120 hours.

When a PET (polyethylene terephthalate) film is used as a substrate, the drying temperature is preferably not greater than 130° C. because the PET film deforms at a temperature greater than 130° C. Therefore, the coated layers are insufficiently crosslinked even when dried at the temperature. Accordingly it is preferable to perform an additional crosslinking process.

When a layer is subjected to a high temperature crosslinking treatment, the surface of the layer tends to deteriorate although crosslinking rapidly proceeds. Therefore, when another layer is formed thereon, problems tend to occur such that the coating liquid cannot be coated evenly, and adhesion between the layers deteriorate. Therefore, the crosslinking treatment is preferably performed under the conditions mentioned above.

Suitable materials for use as the substrate of the recording medium of the present invention include any known supports such as paper, resin films such as PET films, synthetic papers, and the like. The substrate may be a complex substrate in which two or more supports are combined. Suitable thickness of the substrate is from a few $\mu$m to a few mm.

In particular, papers are preferably used as the substrate of document-use reversible thermosensitive recording media because of having a light weight, and having the same stiffness and feeling as general documents, i.e., being easy to handle.

When a paper is used as the substrate, the paper preferably has a smooth surface to produce images having good evenness, clearness and fine line reproducibility. Therefore it is preferable to use coated papers and art papers, to form an undercoat layer and/or to perform a calendering treatment after forming a layer.

The substrate optionally has a magnetic recording layer on the same side of the recording layer or the opposite side. The reversible thermosensitive recording medium of the present invention may be adhered to another medium or device with an adhesive layer therebetween.

In addition, the recording medium of the present invention can be formed by a thermal transfer method. Namely, on a substrate such as PET films, for example, a back layer is formed on one side of the substrate and a release layer, a reversible thermosensitive recording layer and a resins layer are formed one by one on the other side of the substrate to prepare a thermal transfer ribbon. The ribbon is heated from the back layer side, to transfer the recording layer on a support such as papers and resin films with the resin layer therebetween.

The recording medium of the present invention can be processed into any shape such as sheet, card, roll and the like.

The reversible thermosensitive recording medium of the present invention may include an irreversible thermosensitive recording layer. The color of the image of the irreversible thermosensitive recording layer may be the same as or different from that of the reversible thermosensitive recording layer.

On a part of or entire the surface of the recording medium, a print layer may be formed by a printing method such as offset printing, gravure printing, ink jet printing, thermal transfer printing and sublimation thermal printing. In addition, an overcoat layer may be formed on the print layer.

In the present invention, images can be recorded in the recording layer by heating the recording layer, for example, with a thermal pen, a thermal printhead, laser or the like, at an image forming temperature for a short time. When the heating is stopped, the applied heat is quickly diffused, namely, the recorded image is quickly cooled; thereby a stable image can be formed in the recording medium.

The recorded image can be erased by heating the recording layer at a temperature not lower than the image forming temperature T1 with an appropriate heating device and then gradually cooling the recording layer, or by heating the recording layer at a temperature in an image erasing temperature range, i.e., a temperature not lower than the image erasing temperature T2 but lower than the image forming temperature T1. When the wide area of the recording layer is heated for a long time, the temperature of entire the recording layer increases and therefore the recording layer is gradually cooled after stopping heating. Accordingly the image is erased.

Suitable heating devices useful for erasing images include heaters such as ceramic heaters, plane heaters, heat bars, heat rollers or heat stamps; hot air blowing devices; or thermal printheads. When a thermal printhead is used for erasing images, the heat energy applied to the recording layer is preferably controlled so as to be relatively low compared to the heat energy for image recording by controlling the applied voltage and/or pulse width of a pulse applied to the thermal printhead. By using this method, the image recording and erasing operations can be performed with only one thermal printhead, which allows so-called "overwriting".

As the image recording device, thermal printers, sublimation thermal printers and other thermal printers can be used.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Recording Layer Coating Liquid

The following components were mixed and dispersed using a ball mill such that the average particle diameter of the solid components was about 1 $\mu$m.

Color developer having the following formula (1) 4

(1)

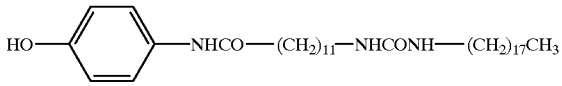

Dialkyl urea 1
(HAKREEN SB from Nippon Kasei Chemical Co., Ltd.)
50% acrylpolyol solution 9
(LR503 from Mitsubishi Rayon Co., Ltd.)
Methyl ethyl ketone 70

Then the following components were added to the above-prepared dispersion and mixed well to prepare a recording layer coating liquid.

2-anilino-3-methyl-6-dibutylamino fluoran 1
Isocyanate compound 2
(CORONATE HL from Nippon Polyurethane Industry Co., Ltd.)

Preparation of Protective Layer Coating Liquid

The following components were mixed well to prepare a protective layer coating liquid.

Crosslinkable ultraviolet absorbing polymer solution 10
(UV-G100 from Nippon Shokubai Co., Ltd. which has a solid content of 40%; a weight average molecular weight of from 20,000 to 30,000; an ultraviolet absorbing structure of a benzotriazole structure; a functional group of a hydroxyl group; and a main chain of a methacrylic ester)
Isocyanate crosslinking agent 1.2
(CORONATE HX from Nippon Polyurethane Industry Co., Ltd., mole ratio NCO/OH of isocyanate group to hydroxyl group of the crosslinkable ultraviolet absorbing polymer of 1.5)
Filler 5
(TOSPEARL 105 from Toshiba Silicone Co., Ltd.)
Methyl ethyl ketone 5

Preparation of Reversible Thermosensitive Recording Medium

The recording layer coating liquid was coated on a polyester film having a thickness of 188 $\mu$m using a wire bar, and then dried at 100° C. for 2 minutes. Then the recording layer was cured at 60° C. for 24 hours. Thus, a recording layer having a weight of about 10 g/m$^2$ was formed.

Then the protective layer coating liquid was coated on the recording layer with a wire bar and then dried at 100° C. for 2 minutes. Then the protective layer was cured at 60° C. for 24 hours. Thus, a protective layer having a weight of about 3 g/m$^2$ was formed.

Thus, a reversible thermosensitive recording medium of the present invention was prepared.

Example 2

Preparation of Recording Layer Coating Liquid

The following components were mixed and dispersed using a ball mill such that the average particle diameter of the solid components was about 1 $\mu$m.

Color developer having the following formula (2) 3

(2)

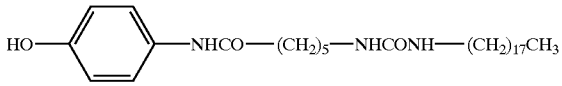

Dialkyl urea 1
(HAKREEN SB from Nippon Kasei Chemical Co., Ltd.)
50% acrylpolyol solution 9
(LR327 from Mitsubishi Rayon Co., Ltd.)
Tetrahydrofuran 35
Methyl ethyl ketone 35

Then the following components were added to the above-prepared dispersion and mixed well to prepare a recording layer coating liquid.

2-anilino-3-methyl-6-dibutylamino fluoran 1
Isocyanate compound 3
(CORONATE HL from Nippon Polyurethane Industry Co., Ltd.)

Preparation of Protective Layer Coating Liquid

The following components were mixed well to prepare a protective layer coating liquid.

Crosslinkable ultraviolet absorbing polymer solution
(UV-A11 from Nippon Shokubai Co., Ltd. which has a solid content of 40%; a weight average molecular weight of from 20,000 to 30,000; an ultraviolet absorbing structure of benzotriazole structure; a functional group of a hydroxyl group; and a main chain of a methacrylic ester)
Isocyanate crosslinking agent 1.4
(CORONATE HX from Nippon Polyurethane Industry Co., Ltd., mole ratio NCO/OH of isocyanate group to hydroxyl group of the crosslinkable ultraviolet absorbing polymer of 1.0)
Filler 5
(TOSPEARL 105 from Toshiba Silicone Co., Ltd.)
Methyl ethyl ketone 7

Preparation of Reversible Thermosensitive Recording Medium

The recording layer coating liquid was coated on a polyester film having a thickness of 188 $\mu$m using a wire bar, and then dried at 100° C. for 2 minutes. Then the recording layer was cured at 60° C. for 24 hours. Thus, a recording layer having a weight of about 10 g/m$^2$ was formed.

Then the protective layer coating liquid was coated on the recording layer with a wire bar and then dried at 100° C. for 2 minutes. Then the protective layer was cured at 60° C. for 24 hours. Thus, a protective layer having a weight of about 3 g/m$^2$ was formed.

Thus, a reversible thermosensitive recording medium of the present invention was prepared.

Example 3

Preparation of Recording Layer Coating Liquid

The following components were mixed and dispersed using a ball mill such that the average particle diameter of the solid components was about 1 $\mu$m.

Color developer having the following formula (3) 3

(3)

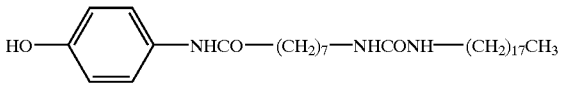

Dialkyl urea 1
(HAKREEN SB from Nippon Kasei Chemical Co., Ltd.)
70% saturated polyester resin solution 6
(DE-140-70 from Dainippon Ink And Chemicals Inc.)
Tetrahydrofuran 60

Then the following components were added to the above-prepared dispersion and mixed well to prepare a recording layer coating liquid.

2-anilino-3-methyl-6-dibutylamino fluoran 1
Isocyanate compound 2

(CORONATE HX from Nippon Polyurethane Industry Co., Ltd.)

Preparation of Intermediate Layer Coating Liquid

The following components were mixed well to prepare an intermediate layer coating liquid.

Crosslinkable ultraviolet absorbing polymer solution 10

(UV-A11 from Nippon Shokubai Co., Ltd.)

Isocyanate crosslinking agent 1.4

(CORONATE HX from Nippon Polyurethane Industry Co., Ltd., mole ratio NCO/OH of isocyanate group to hydroxyl group of the crosslinkable ultraviolet absorbing polymer of 1.0)

Methyl ethyl ketone 7

Preparation of Protective Layer Coating Liquid

The following components were mixed well to prepare a protective layer coating liquid.

Acrylpolyol solution 10

(LR327 from Mitsubishi Rayon Co., Ltd., solid content of 40%)

Isocyanate crosslinking agent 1.5

(CORONATE HX from Nippon Polyurethane Industry Co., Ltd.)

Silicone oil 2

Methyl ethyl ketone 7

Preparation of Reversible Thermosensitive Recording Medium

The recording layer coating liquid was coated on a polyester film having a thickness of 188 $\mu$m using a wire bar, and then dried at 100° C. for 2 minutes. Then the recording layer was cured at 60° C. for 24 hours. Thus, a recording layer having a weight of about 10 g/m$^2$ was formed.

Then the intermediate layer coating liquid was coated on the recording layer with a wire bar and then dried at 100° C. for 2 minutes. Then the intermediate layer was cured at 60° C. for 24 hours. Thus, an intermediate layer having a weight of about 3 g/m$^2$ was formed.

Then the protective layer coating liquid was coated on the recording layer with a wire bar and then dried at 100° C. for 2 minutes. Then the protective layer was cured at 60° C. for 24 hours. Thus, a protective layer having a weight of about 2 g/m$^2$ was formed.

Thus, a reversible thermosensitive recording medium of the present invention was prepared.

Example 4

Preparation of Recording Layer Coating Liquid

The procedure for preparation of the recording layer coating liquid in Example 1 was repeated.

Preparation of Intermediate Layer Coating Liquid

The following components were mixed well to prepare an intermediate layer coating liquid.

Crosslinkable ultraviolet absorbing polymer solution 10

(UV-G714 from Nippon Shokubai Co., Ltd., which has a solid content of 40%; a weight average molecular weight of from 70,000 to 80,000; an ultraviolet absorbing structure of benzotriazole structure; a functional group of a hydroxyl group; and a main chain of a methacrylic ester)

Isocyanate crosslinking agent 1

(CORONATE HX from Nippon Polyurethane Industry Co., Ltd., mole ratio NCO/OH of isocyanate group to hydroxyl group of the crosslinkable ultraviolet absorbing polymer of 0.7)

Methyl ethyl ketone 5

Preparation of Protective Layer Coating Liquid

The following components were mixed well to prepare a protective layer coating liquid.

Urethane-acrylate ultraviolet crosslinkable resin 15

(C7-157 from Dainippon Inc And Chemicals Inc.)

Filler 3

(P527 from Mizusawa Industrial Chemicals Ltd.)

Ethyl acetate 85

Preparation of Reversible Thermosensitive Recording Medium

The recording layer coating liquid was coated on a polyester film having a thickness of 188 $\mu$m using a wire bar, and then dried at 100° C. for 2 minutes. Then the recording layer was cured at 60° C. for 24 hours. Thus, a recording layer having a weight of about 10 g/m$^2$ was formed.

Then the intermediate layer coating liquid was coated on the recording layer with a wire bar and then dried at 100° C. for 2 minutes. Then the intermediate layer was cured at 60° C. for 24 hours. Thus, an intermediate layer having a weight of about 3 g/m$^2$ was formed.

Then the protective layer coating liquid was coated on the recording layer with a wire bar and then dried at 90° C. for 1 minute. Then the protective layer was cured by being fed at a speed of 9 m/min under an ultraviolet lamp having an energy of 80 W/cm. Thus, a protective layer having a thickness of about 2 $\mu$m was formed.

Thus, a reversible thermosensitive recording medium of the present invention was prepared.

Example 5

Preparation of Recording Layer Coating Liquid

The procedure for preparation of the recording layer coating liquid in Example 1 was repeated.

Preparation of Protective Layer Coating Liquid

The following components were mixed well to prepare a protective layer coating liquid.

Crosslinkable ultraviolet absorbing polymer solution 10

(UV-A11 from Nippon Shokubai Co., Ltd., which has a solid content of 40%; a weight average molecular weight of from 20,000 to 30,000; an ultraviolet absorbing structure of benzotriazole structure; a functional group of a hydroxyl group; and a main chain of a methacrylic ester)

Isocyanate crosslinking agent 1.4

(CORONATE HX from Nippon Polyurethane Industry Co., Ltd., mole ratio NCO/OH of isocyanate group to hydroxyl group of the crosslinkable ultraviolet absorbing polymer of 1.0)

Filler 6

(TOSPEARL 103 from Toshiba Silicone Co., Ltd.) Methyl ethyl ketone 7

Preparation of Reversible Thermosensitive Recording Medium

The recording layer coating liquid was coated on a coated paper (SHIRAOI COATED PAPER from Daishowa Paper Manufacturing Co., Ltd.), which has a thickness of 110 $\mu$m, using a wire bar, and then dried at 100° C. for 2 minutes. Then the recording layer was cured at 60° C. for 24 hours. Thus, a recording layer having a weight of about 10 g/m$^2$ was formed.

Then the protective layer coating liquid was coated on the recording layer with a wire bar and then dried at 100°C. for 2 minutes. Then the protective layer was cured at 60C. for 24 hours. Thus, a protective layer having a weight of about 3 g/m$^2$ was formed.

Thus, a reversible thermosensitive recording medium of the present invention was prepared.

The logarithmic decrement of the thus prepared reversible thermosensitive recording medium is shown in FIG. 2.

Comparative Example 1

The procedure for preparation of the recording medium in Example 1 was repeated except that the formulation of the protective layer coating liquid was changed to the following:

Non-crosslinkable ultraviolet absorbing polymer 10
(PUVA-30S from Otsuka Chemical Co., Ltd., which has a weight average molecular weight of 10,000 and an ultraviolet absorbing structure of a benzotriazole structure)
Silicone oil 1
Tetrahydrofuran 7

Thus, a comparative reversible thermosensitive recording medium was prepared.

Comparative Example 2

The procedure for preparation of the recording medium in Example 1 was repeated except that the formulation of the protective layer coating liquid was changed to the following:

40% acrylpolyol solution 10
(LR327 from Mitsubishi Rayon Co., Ltd.)
Isocyanate compound 1.5
(CORONATE HX from Nippon Polyurethane Industry Co., Ltd.)
Low molecular weight ultraviolet absorbent 1
(SUMISORB 310 from Sumitomo Chemical Co., Ltd., which has an ultraviolet absorbing structure of a benzotriazole structure)
Silicone oil 2
Methyl ethyl ketone 7

Thus, a comparative reversible thermosensitive recording medium was prepared.

Comparative Example 3

The procedure for preparation of the recording medium in Example 2 was repeated except that the formulation of the protective layer was changed to the following:

40% acrylpolyol solution 2
(LR327 from Mitsubishi Rayon Co., Ltd.)
Isocyanate compound 0.5
(CORONATE HL from Nippon Polyurethane Industry Co., Ltd.)
Non-crosslinkable ultraviolet absorbing polymer 15
(PUVA-30S from Otsuka Chemical Co., Ltd.)
Silicone oil 1
Methyl ethyl ketone 7

Thus, a comparative reversible thermosensitive recording medium was prepared.

Comparative Example 4

The procedure for preparation of the recording medium in Example 3 was repeated except that the formulation of the intermediate layer was changed to the following:

40% acrylpolyol solution 10
(LR327 from Mitsubishi Rayon Co., Ltd.)
Isocyanate compound 1.5
(CORONATE HX from Nippon Polyurethane Industry Co., Ltd.)
Low molecular weight ultraviolet absorbent 1
(SUMISORB 310 from Sumitomo Chemical Co., Ltd., which has an ultraviolet absorbing structure of a benzophenone structure)
Methyl ethyl ketone 7

Thus, a comparative reversible thermosensitive recording medium was prepared.

Comparative Example 5

The procedure for preparation of the recording medium in Example 3 was repeated except that the formulation of the intermediate layer was changed to the following:

40% acrylpolyol solution 2
(LR327 from Mitsubishi Rayon Co., Ltd.)
Isocyanate compound 0.5
(CORONATE HL from Nippon Polyurethane Industry Co., Ltd.)
Non-crosslinkable ultraviolet absorbing polymer 15
(PUVA-30S from Otsuka Chemical Co., Ltd.)
Methyl ethyl ketone 7

Thus, a comparative reversible thermosensitive recording medium was prepared.

The thus prepared reversible thermosensitive recording media of Examples 1 to 5 and Comparative Examples 1 to 5 were evaluated as follows.

(1) Deformation of Surface of Recording Medium

An image was formed in each of the recording media and then erased using a card printer R3000 manufactured by Kyushu Matsushita Electric Co., Ltd. This image formation/erasure process was repeated 50 times. The surface of the recording medium was observed to determine whether the surface deformed. The deformation was evaluated by being classified into the following 4 grades:

Rank 1: the surface did not deform.
Rank 2: the surface did not deform, but was hurt.
Rank 3: the surface deformed and hurt.
Rank 4: the surface seriously deformed and hurt.

(2) Color Density

The image formation/erasure process mentioned above in item (1) was repeated 50 times to determine whether the color density of the image changed with repetition of the process.

The color density was evaluated by being classified into the following 3 grades:

Rank 1: the image had good evenness and color density hardly changed.
Rank 2: the image was uneven and color density decreased.
Rank 3: the image had poor image quality and color density seriously decreased.

(3) Light Resistance

At first the color density (C1) of a recording medium in an erased state was measured by a Macbeth RD 914. An image was recorded in the recording medium by the card printer R3000 and then exposed to light of 5500 lux for 100 hours. The image was then erased by the card printer R3000. The color density (C2) of the erased image was measured to determine the color density difference (C2−C1). This procedure was also repeated with respect to the image after the image erasure/formation process was repeated 50 times.

(4) Peak Temperature and Logarithmic Decrement

According to the measuring method mentioned above, the peak temperature and logarithmic decrement of the recording medium of Example 5 were measured. The logarithmic decrement of the recording medium of Example 5 is shown in FIG. 2.

In FIG. 2, the peak temperature T is 178° C. and the logarithmic decrement Δ at the peak temperature is 0.17. Therefore it can be said that this recording medium has good heat resistance and the protective layer is inflexible.

TABLE 1

Results are shown in Table 1.

| | Deformation | Color density | Light resistance First Image | Light resistance 50th image | Peak temperature (° C.) | Logarithmic Decrement |
|---|---|---|---|---|---|---|
| Ex. 1 | 1 | 1 | 0.01 | 0.01 | 120 | 0.25 |
| Ex. 2 | 1 | 1 | 0.01 | 0.01 | 180 | 0.13 |
| Ex. 3 | 1 | 1 | 0.01 | 0.01 | 180 | 0.13 |
| Ex. 4 | 1 | 1 | 0.01 | 0.01 | 166 | 0.45 |
| Ex. 5 | 1 | 1 | 0.01 | 0.01 | 178 | 0.17 |
| Comp. Ex. 1 | 4 | 3 | 0.01 | 0.07 | 80 | 0.55 |
| Comp. Ex. 2 | 3 | 3 | 0.01 | 0.05 | 180 | 0.44 |
| Comp. Ex. 3 | 2 | 2 | 0.01 | 0.03 | 110 | 0.50 |
| Comp. Ex. 4 | 3 | 3 | 0.01 | 0.05 | 180 | 0.44 |
| Comp. Ex. 5 | 2 | 2 | 0.01 | 0.03 | 110 | 0.50 |

As can be understood from Table 1, the recording media of Examples 1 to 5 do not have deformation, and have good coloring properties and light resistance even when images are repeatedly formed and erased whereas the recording media of Comparative Examples 1 to 5 have deformation, color density change and poor light resistance when images are repeatedly formed and erased. In particular, the reason of deterioration of the light resistance of the comparative recording media when images are repeatedly formed and erased is considered to be that their ultraviolet absorbing structure changes, precipitates or diffuses.

Example 6

Preparation of Recording Layer Coating Liquid

The procedure for preparation of the recording layer coating liquid in Example 1 was repeated.

Preparation of Protective Layer Coating Liquid

The following components were mixed and dispersed such that the particle diameter of the solid components was about 0.5 $\mu$m.

Crosslinkable ultraviolet absorbing polymer 50

(UV-A11 from Nippon Shokubai Co., Ltd. which has a solid content of 40%; a weight average molecular weight of from 20,000 to 30,000; an ultraviolet absorbing structure of benzotriazole structure; a functional group of a hydroxyl group; and a main chain of a methacrylic ester)

Crosslinkable silicone graft polymer 4

(REZEDA GS-1015 from Toagosei Co., Ltd., which has a solid content of 45%; a weight average molecular weight of about 20,000; a functional group of a hydroxyl group; and a main chain of an acrylpolyol)

Filler 10

(P-832 from Mizusawa Industrial Chemicals Ltd.)

Methyl ethyl ketone 60

Then the following component was added to the dispersion to prepare a protective layer coating liquid.

Isocyanate hardener 8

(CORONATE HX from Nippon Polyurethane Industry Co., Ltd.)

Preparation of Reversible Thermosensitive Recording Medium

The recording layer coating liquid was coated on a coated paper (SHIRAOI COATED PAPER from Daishowa Paper Manufacturing Co., Ltd.), which has a thickness of 110 $\mu$m, using a wire bar, and then dried at 100° C. for 2 minutes. Then the recording layer was cured at 60° C. for 24 hours. Thus, a recording layer having a weight of about 10 g/m$^2$ was formed.

Then the protective layer coating liquid was coated on the recording layer with a wire bar and then dried at 100° C. for 2 minutes. Then the protective layer was cured at 60° C. for 24 hours. Thus, a protective layer having a weight of about 3 g/m$^2$ was formed.

Thus, a reversible thermosensitive recording medium of the present invention was prepared.

This reversible thermosensitive recording medium was subjected to the evaluation tests mentioned above. The results are shown in Table 2.

In addition, the logarithmic decrement of the thus prepared reversible thermosensitive recording medium is shown in FIG. 3. In FIG. 3, the peak temperature T is 157° C., and the logarithmic decrement Δ at the peak temperature T is 0.18. Namely, it can be said that this recording medium has good heat resistance and the protective layer is inflexible.

In addition, this recording medium was subjected to writability, fixability and erasability tests using a maker pen mentioned below. Further, the dynamic receding contact angle of the surface was also measured by the method mentioned below. The results are shown in Table 3.

TABLE 2

| | Deformation | Color density | Light resistance First Image | Light resistance 50th image | Peak temperature (° C.) | Logarithmic Decrement |
|---|---|---|---|---|---|---|
| Ex. 6 | 1 | 1 | 0.01 | 0.01 | 157 | 0.18 |

TABLE 3

| | Dynamic receding contact angle (°) | Writability | Fixability | Erasability |
|---|---|---|---|---|
| Ex. 6 | 87.3 | ○ | ○ | ○ |

As can be understood from Tables 2 and 3, the reversible thermosensitive recording medium of Example 6 do not have deformation, and have good coloring properties and light resistance even when images are repeatedly formed and erased, and in addition the recording medium has good writability, fixability and erasability when an image is written by a marker pen.

Then the improvement of writability of the reversible thermosensitive recording material of the present invention will be explained referring to examples. In the below-mentioned Examples 7 to 10, only the image writability, fixability and erasability of the surface thereof using a marker pen are improved.

Example 7

Preparation of Recording Layer

The following components were mixed and dispersed using a ball mill such that the average particle diameter of the solid components was about 1 $\mu$m.

2-anilino-3-methyl-6-dibutylaminofluoran 2

Color developer having the following formula 8

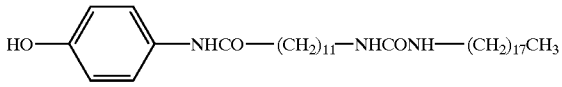

Color formation/erasure controlling agent having the following formula 3

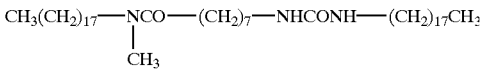

Acrylpolyol solution 15
(LR503 from Mitsubishi Rayon Co., Ltd.)
Tetrahydrofuran 130

Then the following component was added to the above-prepared dispersion and mixed well to prepare a recording layer coating liquid.

Ethyl acetate solution of isocyanate compound 20
(CORONATE HL from Nippon Polyurethane Industry Co., Ltd., which is an adduct type hexamethylene diisocyanate and which has a solid content of 75%)

The recording layer coating liquid was coated on a polyester film having a thickness of 188 μm using a wire bar, and then dried at 100° C. for 2 minutes. Then the recording layer was cured at 60° C. for 24 hours. Thus, a recording layer having a weight of about 8 g/m$^2$ was formed.

Preparation of Protective Layer

The following components were mixed and dispersed using a ball mill such that the average particle diameter of the solid components was about 0.5 μm.

Acrylpolyol resin 10
(LR503 from Mitsubishi Rayon Co., Ltd.)
Alumina 7
(AL-150SG from Showa Denko K. K.)
Silicone graft polymer 0.6
(FS700 from NOF Corporation)
Methyl ethyl ketone 50

Then the following component was added to the dispersion to prepare a protective layer coating liquid.

Solution of isocyanate compound 4
(CORONATE HX from Nippon Polyurethane Industry Co., Ltd.)

Then the protective layer coating liquid was coated on the recording layer with a wire bar and then dried at 100° C. for 2 minutes. Then the protective layer was cured at 60° C. for 24 hours. Thus, a protective layer having a weight of about 3 g/m$^2$ was formed.

Thus, a reversible thermosensitive recording medium of the present invention was prepared.

Example 8

The procedure for preparation of the reversible thermosensitive recording medium in Example 7 was repeated except that the protective layer coating liquid was changed to the following:

Acrylpolyol resin 10
(LR327 from Mitsubishi Rayon Co., Ltd.)
Talc 4
(#12 from Muramatsu Sangyo K. K.)
Silicone graft polymer 0.6
(FS700 from NOF Corporation)
Methyl ethyl ketone 50

These components were mixed and dispersed using a ball mill such that the average particle diameter of the solid components was about 1.0 μm.

The following component was added to the dispersion to prepare a protective layer coating liquid.

Isocyanate compound 4
(CORONATE HX from Nippon Polyurethane Industry Co., Ltd.)

Example 9

The procedure for preparation of the reversible thermosensitive recording medium in Example 7 was repeated except that the protective layer coating liquid was changed to the following:

Acrylpolyol resin 10
(LR327 from Mitsubishi Rayon Co., Ltd.)
Silica 4
(P-832 from Mizusawa Industrial Chemicals Ltd.)
Silicone graft polymer 1.2
(FS700 from NOF Corporation)
Methyl ethyl ketone 50

These components were mixed and dispersed using a ball mill such that the average particle diameter of the solid components was about 1.0 μm.

The following component was added to the dispersion to prepare a protective layer coating liquid.

Isocyanate compound 4
(CORONATE HX from Nippon Polyurethane Industry Co., Ltd.)

Example 10

The procedure for preparation of the reversible thermosensitive recording medium in Example 9 was repeated.

Comparative Example 6

The procedure for preparation of the reversible thermosensitive recording medium in Example 7 was repeated except that the average particle diameter of the solid components of the protective layer coating liquid was changed to 3.0 μm.

Comparative Example 7

The procedure for preparation of the reversible thermosensitive recording medium in Example 7 was repeated except that the protective layer coating liquid was changed to the following coating liquid.

Acrylpolyol resin 10
(LR503 from Mitsubishi Rayon CO., Ltd.)
Talc 4
(#12 from Muramatsu Sangyo K. K.)
Methyl ethyl ketone 50

These components were mixed and dispersed using a ball mill such that the average particle diameter of the solid components was 1.0 μm. Then the following component was added to the dispersion prepared above.

Isocyanate compound 4
(CORONATE HX from Nippon Polyurethane Industry Co., Ltd.)

Comparative Example 8

The procedure for preparation of the reversible thermosensitive recording medium in Example 7 was repeated except that the protective layer coating liquid was changed to the following coating liquid.

Acrylpolyol resin 10
(LR327 from Mitsubishi Rayon CO., Ltd.)
Silica 1.5
(P-832 from Mizusawa Industrial Chemicals Ltd.)
Silicone graft polymer 2.4
(FS700 from NOF Corporation)
Methyl ethyl ketone 50

The following components were mixed and dispersed using a ball mill such that the average particle diameter of the solid components was 1.0 μm. The following component was added to the dispersion prepared above.

Isocyanate compound 4
(CORONATE HX from Nippon Polyurethane Industry Co., Ltd.)

When an image was recorded in each of the recording media of Examples 7 to 10 and Comparative Examples 6 to 8 using a thermal recording apparatus manufactured by Ohkura Electric Co., Ltd. under conditions of 13.3 V in applied voltage and 1.2 ms in pulse width, all the images had a high image density.

When the images were erased by heating at 120° C. for 1 second using a heat gradient tester manufactured by Toyo Seiki Seisaku-sho, Ltd., all the images were clearly erased.

In addition, when the dynamic receding contact angle of the surface of each recording medium against distilled water was measured by the following method:

Measurements of Dynamic Receding Contact Angle

The dynamic receding contact angle was measured using a dynamic receding contact angle measuring instrument DCA-20 manufactured by Orientec Co., Ltd. At this point, the speed of dipping a sample into distilled water was 100 mm/min.

Further, writability, fixability of an image written on the surface of each recording medium and erasability of the written image were evaluated by the following methods.

(1) Writability

An image was written using a marker pen MARKER PEACE (black) manufactured by Mitsubishi Pencil Co., Ltd. for each of the recording media of Examples 6 to 9 and Comparative Examples 6 to 8. An image was written using a marker pen MARKER YYF1 manufactured by Zebra Co., Ltd. for the recording medium of Example 10. The writability was evaluated by being classified as follows:

○: Good (the image is clearly written without repelling)
Δ: Fair (the written image is slightly unclear due to repelling)
■: Poor (the written image is unclear due to serious repelling)

(2) Fixability of Written Image

A written image was rubbed with a PET film having a thickness of 188 μm. The Fixability was evaluated by being classified as follows:

○: Good (the image is hardly removed)
Δ: Fair (a part of the written image is removed)
■: Poor (almost entire the written image is removed)

(3) Erasability of Written Image

A written image was rubbed with a swab. The Fixability was evaluated by being classified as follows:

○: Good (the image can be removed)
Δ: Fair (a part of the written image remains)
■: Poor (the written image can be hardly erased)

The results are shown in Table 4.

TABLE 4

| | Dynamic receding contact angle (°) | Writability | Fixability | Erasability |
|---|---|---|---|---|
| Ex. 7 | 86.1 | Δ | ○ | ○ |
| Ex. 8 | 91.7 | ○ | ○ | ○ |
| Ex. 9 | 92.1 | ○ | ○ | ○ |
| Ex. 10 | 92.1 | ○ | ○ | ○ |
| Comp. Ex. 6 | 50.4 | ○ | ○ | ■ |
| Comp. Ex. 7 | 65.5 | ○ | ○ | ■ |
| Comp. Ex. 8 | 107.8 | ■ | — | — |

In addition, when each of the recording media of Examples 7 to 10 was repeatedly subjected to the cycle of the image erasing/recording process, and writability, fixability and erasability tests mentioned above 50 times. As a result, colored images were clearly formed and erased in the recording layer. In addition, the writability, fixability and erasability of the surface of the recording media were not changed.

As can be understood from the above description, the reversible thermosensitive recording medium of the present invention does not cause a deformation problem even after long repeated use and which can be used for document applications as well as card applications while having good light resistance. In addition, the reversible thermosensitive recording medium of the present invention has a surface on which an image can be written by a writing material such as marker pens and the image can be erased by an eraser such as non-woven cloths, papers, sponges, rubbers, cloths, etc. without a residue thereon while the image has a fixability so as not to be erased when contacted with other documents.

This document claims priority and contains subject matter related to Japanese Patent Applications No. 2000-308922 and 2000-360426, filed on Oct. 10, 2000, and Nov. 28, 2000, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A reversible thermosensitive recording medium comprising:

a substrate; and a reversible thermosensitive recording portion comprising:

a recording layer on the substrate, which comprises an electron donating coloring compound and an electron accepting compound, wherein the recording layer achieves a colored state when heated at a temperature not lower than an image forming temperature and then cooled at a first cooling speed, and the recording layer in the colored state achieves a non-colored state when heated at a temperature lower than the image forming temperature and not lower than an image erasing temperature or when heated at a temperature not lower than the image forming temperature and then cooled at a second cooling speed relatively slow compared to the first cooling speed; and a crosslinked polymer layer comprising a crosslinked polymer having an ultraviolet absorbing structure.

2. The reversible thermosensitive recording medium according to claim 1, wherein the recording layer serves as the crosslinked polymer layer.

3. The reversible thermosensitive recording medium according to claim 1, wherein the crosslinked polymer layer is located on the recording layer.

4. The reversible thermosensitive recording medium according to claim 1, wherein the crosslinked polymer layer has a viscoelastic logarithmic decrement property such that a peak temperature is not lower than 100° C., and a logarithmic decrement at the peak temperature is not greater than 0.3.

5. The reversible thermosensitive recording medium according to claim 1, wherein the crosslinked polymer layer has a viscoelastic logarithmic decrement property such that a peak temperature is not lower than 150° C., and a logarithmic decrement at the peak temperature is not greater than 0.6.

6. The reversible thermosensitive recording medium according to claim 1, wherein the ultraviolet absorbing structure of the crosslinked polymer layer is selected from the group consisting of a benzotriazole structure and a benzophenone structure.

7. The reversible thermosensitive recording medium according to claim 1, wherein the crosslinked polymer layer is prepared by crosslinking a polymer having a hydroxyl group.

8. The reversible thermosensitive recording medium according to claim 7, wherein the crosslinked polymer layer is prepared by crosslinking the polymer having a hydroxyl group with a hardener having an active group.

9. The reversible thermosensitive recording medium according to claim 8, wherein the hardener is an isocyanate compound.

10. The reversible thermosensitive recording medium according to claim 8, wherein a ratio (Na/Nh) of the number (Na) of the active groups of the hardener to the number (Nh) of hydroxyl groups of the polymer is from 0.3 to 2.0.

11. The reversible thermosensitive recording medium according to claim 1, wherein the crosslinked polymer has at least one of an acrylic main chain and a polyester main chain.

12. The reversible thermosensitive recording medium according to claim 1, wherein the crosslinked polymer has a weight average molecular weight not less than 10,000.

13. The reversible thermosensitive recording medium according to claim 1, further having a surface layer having a dynamic receding contact angle of from 75° to 100° against distilled water.

14. The reversible thermosensitive recording medium according to claim 13, wherein the surface layer is the crosslinked polymer layer.

15. The reversible thermosensitive recording medium according to claim 14, wherein the surface layer comprises a silicone-modified polymer and wherein the silicone-modified polymer is crosslinked with the crosslinked polymer.

16. The reversible thermosensitive recording medium according to claim 13, wherein the surface layer is located on the crosslinked polymer layer, and wherein the crosslinked polymer is located on the recording layer.

17. The reversible thermosensitive recording medium according to claim 13, wherein the surface layer comprises a silicone-modified polymer.

18. The reversible thermosensitive recording medium according to claim 13, wherein the surface layer comprises a filler.

19. The reversible thermosensitive recording medium according to claim 18, wherein the filler is coated with a calcium compound.

20. The reversible thermosensitive recording medium according to claim 18, wherein the filler has an average particle diameter of from 0.2 to 2.0 $\mu$m.

21. The reversible thermosensitive recording medium according to claim 1, wherein the substrate is a paper.

22. The reversible thermosensitive recording medium according to claim 1, further comprising an information storing portion.

23. The reversible thermosensitive recording medium according to claim 1, having at least one of a card shape, a sheet shape or a roll shape.

24. The reversible thermosensitive recording medium according to claim 1, further comprising a print portion.

25. A reversible thermal image recording method comprising:

providing a reversible thermosensitive recording medium comprising a recording layer on the substrate, which comprises an electron donating coloring compound and an electron accepting compound, wherein the recording layer achieves a colored state when heated at a temperature not lower than an image forming temperature and then cooled at a first cooling speed, and the recording layer in the colored state achieves a non-colored state when heated at a temperature lower than the image forming temperature and not lower than an image erasing temperature or when heated at a temperature not lower than the image forming temperature and then cooled at a second cooling speed relatively slow compared to the first cooling speed; and a crosslinked polymer layer comprising a crosslinked polymer having an ultraviolet absorbing structure on the recording layer; and imagewise heating the recording layer at a temperature not lower than the image forming temperature and then cooling at the first cooling speed to form an image in the recording layer.

26. A reversible thermal image erasing method comprising:

providing a reversible thermosensitive recording medium comprising a recording layer on the substrate, which comprises an electron donating coloring compound and an electron accepting compound, wherein the recording layer achieves a colored state when heated at a temperature not lower than an image forming temperature and then cooled at a first cooling speed, and the recording layer in the colored state achieves a non-colored state when heated at a temperature lower than the image forming temperature and not lower than an image erasing temperature or when heated at a temperature not lower than the image forming temperature and then cooled at a second cooling speed relatively slow compared to the first cooling speed; and a crosslinked polymer layer comprising a crosslinked polymer having an ultraviolet absorbing structure on the recording layer; and heating the recording layer at a temperature not higher than the image forming temperature and not lower than the image erasing temperature such that the recording layer achieves the non-colored state.

* * * * *